United States Patent [19]

Nergard

[11] 4,303,173

[45] Dec. 1, 1981

[54] MUG TYPE DRINKING RECEPTACLE WITH COVER AND VALVE

[75] Inventor: Orv B. Nergard, Fridley, Minn.

[73] Assignee: Dart Industries Inc., Los Angeles, Calif.

[21] Appl. No.: 54,321

[22] Filed: Jul. 2, 1979

[51] Int. Cl.[3] ..... A47G 19/22

[52] U.S. Cl. ..... 220/254; 220/90.4; 220/264; 222/470; 222/518

[58] Field of Search ..... 222/511, 518, 470; 220/90.4, 264, 254

[56] References Cited

U.S. PATENT DOCUMENTS

| | | | |
|---|---|---|---|
| 93,785 | 8/1869 | Wolf | 222/511 |
| 118,860 | 9/1971 | Kent | 222/470 X |
| 1,380,973 | 6/1921 | Kelseg | 222/470 X |
| 2,154,346 | 4/1939 | Mills | 222/566 X |
| 2,799,437 | 7/1957 | Jepson | 222/470 X |
| 3,847,311 | 11/1974 | Flores et al. | 222/518 X |
| 3,964,631 | 6/1976 | Albert | 220/90.4 |
| 3,972,443 | 8/1976 | Albert | 220/264 X |
| 4,099,642 | 7/1978 | Nergard | 222/518 X |

*Primary Examiner*—Allan N. Shoap
*Attorney, Agent, or Firm*—Kenneth J. Hovet

[57] ABSTRACT

An open top receptacle with a laterally extending handle on one side is arranged to receive a cup-shaped cover. This cover includes a valve assembly to close off an opening in the top of the cover to prevent spilling or splashing of either hot or cold beverages from the receptacle. The valve assembly in turn includes a valve head biased against the opening in the cover by resilient integral supporting arms secured to the underside of the cover. An actuating member passes into one side of the cover at a point spaced 90° from the opening, this point being generally vertically above the lateral handle on the receptacle. With this arrangement, a person can hold the handle of the receptacle in the manner of a mug using the thumb to depress the actuating member inwardly which action moves the valve head away from the opening in the cover to permit drinking of the beverage in the receptacle. Releasing of the actuating member by the thumb permits the resilient supporting arms for the valve head to close off the opening.

3 Claims, 8 Drawing Figures

MUG TYPE DRINKING RECEPTACLE WITH COVER AND VALVE

This invention relates generally to drinking receptacles and more particularly to a mug type drinking receptacle with cover and valve assembly to inhibit spilling.

BACKGROUND OF THE INVENTION

Drinking receptacles with covers incorporating manually operable valves are well known in the art. These receptacles are generally used for holding coffee or the like by persons travelling to and from work or in any similar situation where the receptacle is subject to motion. The cover and valve assemblies are designed to effectively seal off the open top of the receptacle and prevent spillage. When it is desired to drink from the receptacle, the valve mechanism is operated by depressing a valve stem extending from the side of the cover by a person's finger to open a beverage outlet opening on a diametrically opposite portion of the cover from which the person can drink. Releasing of the valve stem or actuating member results in the opening being automatically closed.

Many problems associated with prior art drinking receptacles of the foregoing type, such as failure for a valve mechanism to properly close, provision of metal parts which can corrode and thus render the valve mechanism inoperative, general complications and expense, and the like have been overcome by a specially designed drinking receptacle as disclosed and claimed in U.S. Pat. No. 4,099,642 issued July 11, 1978 and entitled DRINKING RECEPTACLE COVER AND VALVE ASSEMBLY. This patent and the invention described therein has been assigned to the same assignee as the present invention and is the closest prior art, along with the reference cited therein, to the present invention of which Applicant is aware.

In the above-identified patent, there is shown a receptacle more or less in the form of an elongated thermos-like structure having a cover with an opening at one peripheral portion and an actuating member at an opposite peripheral portion. The arrangement is such that a person can drink from the opening while depressing the actuating member with his index finger, the person's hand being wrapped about the outer surface of the receptacle.

While the receptacle and cover assembly is highly satisfactory for many beverages, there can exist instances in which a very hot beverage is held in the container heating the container itself sufficiently that it becomes uncomfortable for a person to hold when drinking therefrom. In such instance, it would be desirable to provide a container or receptacle with a handle. However, provision of such a handle on the specifically designed cover and valve assembly set forth in the above-identified patent would render it difficult to operate the valve mechanism itself with the same hand holding the receptacle by the handle. Some redesign would be required.

BRIEF DESCRIPTION OF THE PRESENT INVENTION

With the foregoing considerations in mind, the present invention contemplates an improved receptacle with cover and valve assembly overcoming all of the problems of the prior art and having the same advantages as the receptacle described in the above-mentioned patent. In addition, however, the receptacle and cover and valve assembly of the present invention is in the form of a mug wherein a person can easily hold the receptacle by a laterally extending handle and operate the valve mechanism with the thumb of the same hand, all to the end that a still further improved drinking receptacle results.

Briefly, the mug type drinking receptacle of this invention comprises a drinking receptacle having an open top and laterally extending handle on one side. A flat plate and surrounding rim define a cup-shaped cover for closing off the open top of the receptacle. The plate itself has an opening adjacent to a first point of the rim and both receptacle and cover include inter-engaging means for removably securing the cover to the receptacle in a position in which this opening is circumferentially spaced 90° from the handle. An actuating member for an appropriate valve head disposed beneath the opening in the plate of the cover passes through a side opening in the rim at a point circumferentially spaced 90° from the opening so as to fall in general vertical alignment with the handle. This actuating member terminates in a camming surface engaging a portion of the valve head such that when the member is urged inwardly through the side opening in the rim, it cams the valve head away from the opening to permit a person to drink a beverage from the receptacle by holding the handle with one hand in the manner of a mug and operating the actuating member with the thumb.

As in the structure described in the heretofore mentioned U.S. Patent, there are no metal parts required whatsoever so that no problems exist with respect to corrosion. Further, by disposing the drinking opening circumferentially 90° from the gripping handle for the receptacle, the same is very easy to operate and to drink from as opposed to the different type receptacle described in the above-mentioned patent, wherein the actuating member is diametrically opposite the drinking opening and no gripping handle is provided.

BRIEF DESCRIPTION OF THE DRAWINGS

A better understanding of this invention will be had by now referring to a preferred embodiment thereof as illustrated in the accompanying drawings in which.

DETAILED DESCRIPTION OF THE PREFERRED EMBODIMENT

Figure 1:
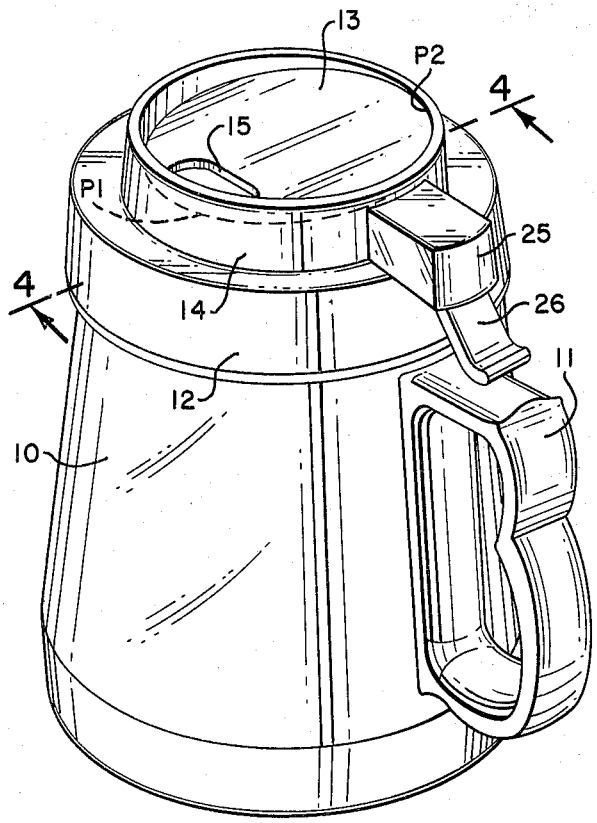
FIG. 1 is a perspective view of the mug type drinking receptacle with cover and valve assembly in place in accord with the present invention.
Figure 2:
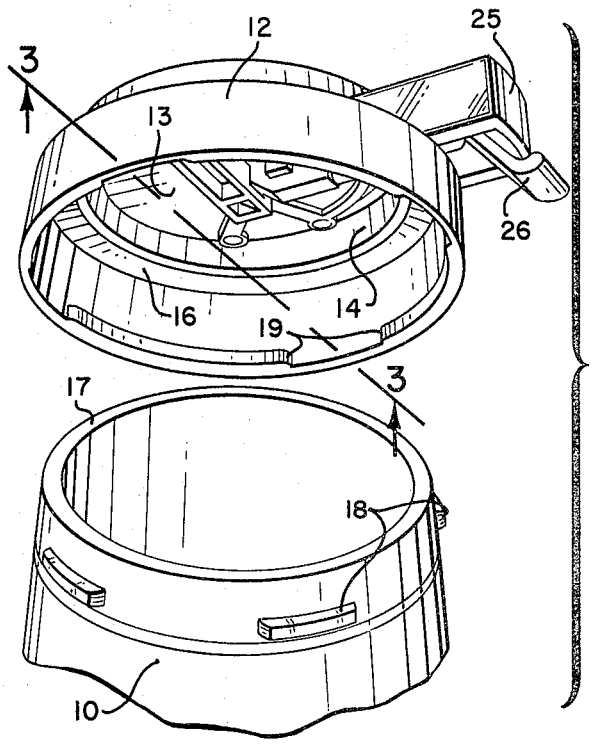
FIG. 2 is a fragmentary exploded view showing the cover separated from the open top of the receptacle.

Referring to both FIGS. 1 and 2, the invention comprises a drinking receptacle 10 having a laterally extending handle 11 on one side as shown.

A cup-shaped cover for closing off the receptacle includes a lower annular wall portion 12 dimensioned to surround the upper exterior portion of the receptacle and a flat plate 13 with a surrounding rim 14 of lesser diameter than the annular wall 12. Plate 13 includes an opening 15 adjacent to a first peripheral point P1 of the rim 14. It will be noted that the plate 13 is slanted or tilted slightly between the point P1 and a diametrically opposite point P2 such that any spilled liquid on the top of the plate 13 will gravitate to the opening 15.

As shown most clearly in FIG. 2, an annular step 16 within the cover is defined between the annular wall 12 and reduced diameter rim 14, this step 16 being provided with an appropriate rubber gasket or sealing means for seating on the open top peripheral edge 17 of the receptacle 10. Appropriate inter-engaging means such as circumferential segment type ridges 18 on the outer surface of the container 10 and cooperating radially inwardly directed lips 19 on the lower edge of the annular wall 12 of the cover serve to secure the cover 12 over the top of the receptacle 10.

More particularly, the ridges 18 are received between the lips 19 and the cover then twisted, the lips being provided with a slight slope so that the cover comes tightly into engagement with the top edge 17 of the receptacle.

When the cover is in its secured position on top of the receptacle 10, the opening 15 as illustrated in FIG. 1 is circumferentially spaced 90° from the position of the handle 11 for the receptacle.

Figure 3:
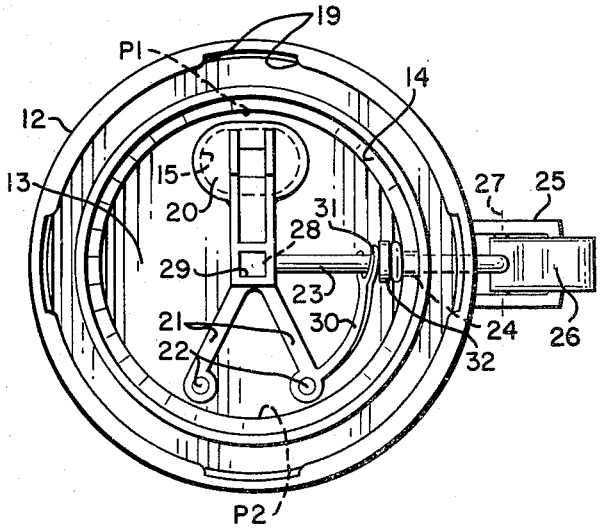
FIG. 3 is an underside plan view of the cover looking in the direction of the arrows 3—3 of FIG. 2.

Referring now to the underside view of FIG. 3, there is shown a valve head structure 20 positioned beneath the bottom surface of the plate 13 and dimensioned to close the opening 15 when moved upwardly against the bottom surface. This valve head has first and second integrally formed resilient arms 21 extending from opposite side portions thereof in diverging directions as shown along the bottom surface of the plate to terminate at securement points 22 to the bottom surface. These points fall adjacent to either side of the second point P2 of the rim. The arrangement is such that the valve head 20 is held against the bottom surface of the plate to close off the elongated opening 15 by the resilient arms 21.

A manually operable actuating member 23 extends through an opening 24 in the rim 14 in a loose fit at a point circumferentially spaced 90° from the first point P1 on the rim as is evident from FIG. 3. With this arrangement, the extending end of the actuating member 23 from the rim 14 falls in general vertical alignment with the handle 11 of the receptacle as will become clearer as the description proceeds.

In the preferred embodiment illustrated in FIGS. 1 to 3, there is provided an external housing 25 constituting an integral portion of the rim 14 and a cooperating lever member 26 pivoted for swinging movement about an horizontal axis depicted by the dashed lines 27 within the housing 25. The arrangement is such that the extending end of the actuating member 23 from the rim engages the lever 26 at a point below its pivoting axis so that inward or swinging movement of the lever 26 will depress inwardly the actuating member 23.

The housing and lever structure merely facilitates inward urging the actuating member 23 by a person's thumb when gripping the handle 11.

The inner end of actuating member 23 as will also become clearer as the description proceeds, terminates in a camming surface 28. The underside of the valve head structure 20 in turn defines a cooperating camming surface 29 engaged by camming surface 28 such that inward movement of the member 23 cams the valve head away from the opening 15 and flexes portions of the first and second arms 21 away from the bottom surface to open the opening.

In order to return the actuating member 23 to its normally outwardly extending position, there is provided a further resilient strip integrally connected to one of the resilient arms, this resilient strip being indicated at 30 in FIG. 3 and being biased into a curve lying in a plane below or parallel to the underside of the plate 13. The extending end of this strip terminates in a forked end 31 shown engaging the actuating member 23 in such a manner as to bias the actuating member 23 in an outward direction. This biasing results from a tendency from the curved resilient strip 30 to straighten out. A collar 32 is provided against which the forked end 31 bears.

Figure 4:
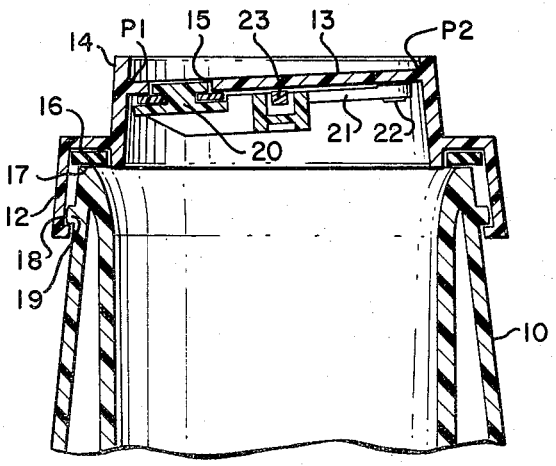
FIG. 4 is a fragmentary cross section of the receptacle and cover in assembled relationship looking in the direction of the arrows 4—4 of FIG. 1.

FIG. 4 shows various ones of the components described thus far in cross section wherein it will be evident that the plate 13 slopes from the first point P1 towards the diametrically opposite point P2, the opening 15 being adjacent to the first peripheral point P1. As described, this structure causes any spilled liquid on top of the plate 13 to gravitate towards the opening.

FIG. 4 also illustrates the inter-engagement of the ribs 18 and lips 19 when the cover is locked in position on top of the receptacle 10. The actual structural configuration of the valve head 20 itself is clear from the cross section and is essentially the same as that described in the heretofore mentioned patent.

Referring now to FIGS. 5 through 8, the camming action briefly referred to heretofore for operating the valve will be better understood.

Figure 5:
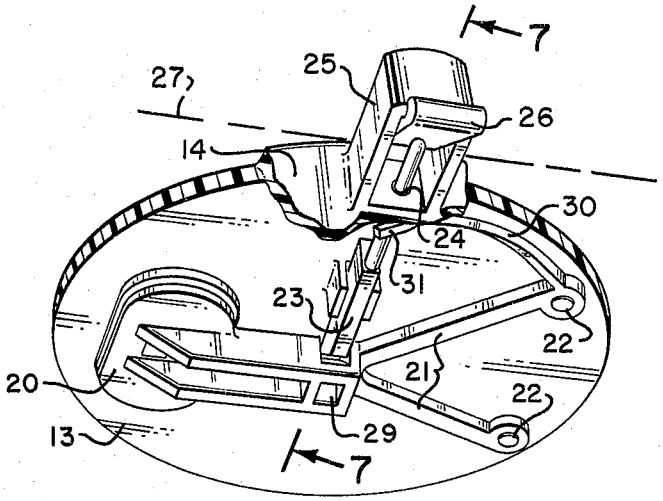
FIG. 5 is a perspective underside view partly broken away of the cover assembly showing the valve head in closed position.

FIG. 5 shows the valve head 20 in fully closed position wherein the resilient strip 30 has biased the actuating member 23 to its outermost position against the lever 26, the collar 32 bearing against the periphery of the opening 24 and serving as a stop.

Figure 6:
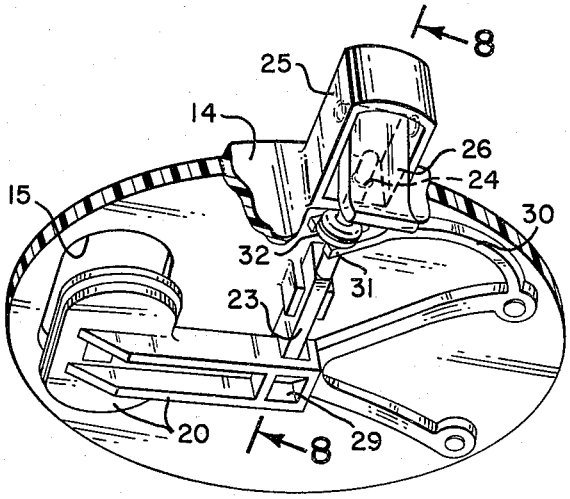
FIG. 6 is a view similar to FIG. 5 but showing the valve head in open position.

FIG. 6 shows the same components as FIG. 5 but after actuating member 23 has been depressed inwardly by depression of the lever 26 by a person's thumb. As shown, the valve head 20 has been moved away from the opening 15 to thereby open the same.

Figure 7:
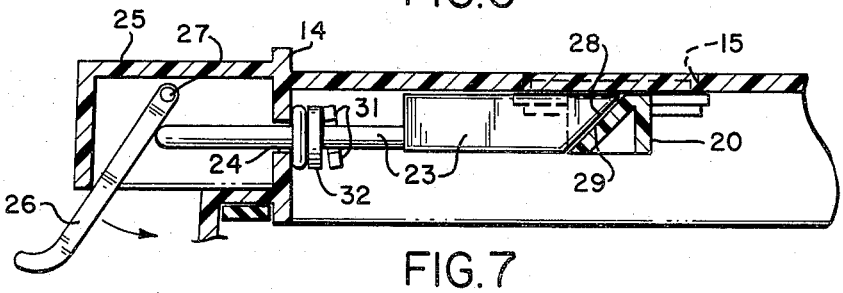
FIG. 7 is a cross section taken in the direction of the arrows 7—7 of FIG. 5.
Figure 8:
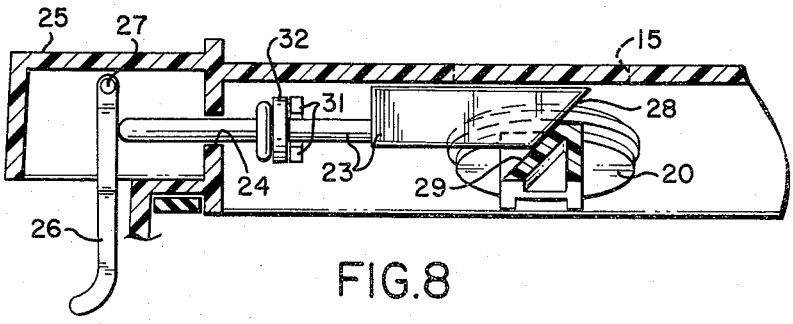
FIG. 8 is another cross section taken in the direction of the arrows 8—8 of FIG. 6.

FIG. 7 shows the position of the components with the valve head 20 closed as described with respect to FIG. 5 while FIG. 8 is a cross section showing the components in position when the valve head is open.

The camming action between the camming surfaces 28 and 29 is clearly illustrated in FIGS. 7 and 8.

It will be appreciated that the upward biasing of the valve head structure 20 by the diverging resilient arms 21 will in turn exert a biased force on the actuating member 23 through the camming surfaces 29 and 28, tending to move the actuating member 23 outwardly. However, a more positive and reliable action to assure that the valve closes is provided by the addition of the resilient strip 30 acting directly on the actuating member 23 to bias radially outwardly. This action assures that the camming surface 28 will be removed from under the camming surface 29 to permit the valve head 20 to fully seat on the underside of the opening 15 when the same is to be closed.

It will be appreciated, as in the case of the receptacle described in the heretofore mentioned patent, that the opening 15 is elongated in a direction at right angles to a diametric line connecting the points P1 and P2. This elongation minimizes any tendency for the beverage to spill when a person positions his mouth over the opening to drink the beverage, the person's mouth being elongated in a like direction.

It will thus be appreciated that the present invention has the many advantages and features of the drinking receptacle described in the heretofore mentioned U.S. patent. In addition, it will be appreciated that the present invention provides a mug-type receptacle wherein the same can easily be operated by a person holding the handle of the receptacle and actuating the valve mechanism with the thumb of his hand. A further improvement in the present structure as a consequence of bringing in the actuating member at a point circumferentially spaced 90° from the opening is that the resilient curved strip serving as a biasing for the actuating member in an outward direction can lie in a plane generally parallel to the underside of the cover plate as opposed to being curved in a vertical plane as characterized the resilient strip in the heretofore mentioned U.S. patent. The orientation of the curved strip in a horizontal plane immediately beneath the plate as in the present case minimizes downwardly projecting portions in the valve mechanism and to such extent minimizes contact of the valve mechanism with beverages in the receptacle.

What is claimed is:

1. A mug type drinking receptacle with cover and valve assembly, including, in combination:

(a) a drinking receptacle having an open top and laterally extending handle on one side;

(b) a flat plate and surrounding rim defining a cup-shaped cover for closing off said open top of said receptacle, said plate having an opening adjacent to a first point of said rim, said receptacle and cover having inter-engaging means for removably securing said cover to said receptacle in a position in which said opening is circumferentially spaced 90° from said handle;

(c) a valve head beneath said opening in said plate having resilient support means secured to the bottom surface of said plate biasing the valve head upwardly against the bottom periphery of said opening to normally close said opening; and (d) an actuating member passing through a side opening in said rim beneath the undersurface of said plate at a point circumferentially spaced 90° from said opening so as to fall in vertical alignment with said handle, said member terminating in a camming surface engaging a portion of said valve head such that when said member is urged upwardly through said side opening in said rim, it cams said valve head away from said opening to thereby open the same so that a person can drink a beverage from said receptacle by holding said handle with one hand in the manner of a mug and operating said actuating member with the thumb, said resilient support means further including an integrally formed resilient strip biased into a curve lying in a plane parallel to the underside of said plate, the extending end of said strip engaging said actuating member to bias it outwardly as a result of said strip tending to straighten.

2. A mug type drinking receptacle with cover and valve assembly, including, in combination:

(a) a drinking receptacle having an open top and a laterally extending handle on one side;

(b) a cup shaped cover for closing off said open top of said receptacle including a lower annular wall portion dimensioned to surround the upper exterior portion of said open top and an upper annular wall portion of reduced diameter forming a rim and defining an internal downwardly facing annular step for seating on the periphery of said open top, an interior portion of said lower annular wall and exterior portion of said open top having integrally formed inter-engaging means for removably securing said cover to said receptacle, said cover further including a flat plate surrounded by and integrally formed with said rim, said plate being slanted slightly from the horizontal and having top and bottom surfaces so that the top surface of said plate slopes upwardly relative to said rim between a first point and a second diametrically opposite point of said rim, said plate having an opening adjacent to said first point of said rim elongated in a direction at right angles to a diametric line extending between said first and second points, said first point being spaced circumferentially 90° from said handle when said cover is secured to said receptacle;

(c) a valve head positioned beneath the bottom surface of said plate and dimensioned to close said opening when moved upwardly against said bottom surface, said valve head having first and second integrally formed resilient arms extending from opposite side portions thereof in diverging directions along the bottom surface of said plate to terminate at securement points to said bottom surface, adjacent to either side of the second point of said rim such that said valve head is held against said bottom surface of said plate to close off said elongated opening by said resilient arms, one of said resilient arms including an integrally formed resilient strip biased into a curve lying in a plane below and parallel to the underside of said plate, the extending end of said strip terminating in a forked end; and (d) a manually operable actuating member extending through said rim in a loose fit at a point circumferentially spaced 90° from said first point to fall in general vertical alignment with said handle, said actuating member passing beneath the bottom surface of said plate, the inner end of said member terminating in a camming surface, the under side of said valve head defining a cooperating camming surface such that inward movement of said member cams said valve head away from said opening and flexes portions of said first and second arms away from said bottom surface to open said opening, said forked end of said strip being coupled to said member to exert a bias force as a result of its tendency to straighten from its curved configuration to move said member outwardly so that said valve head can be closed against said opening by said flexible arms when said member is released, whereby said receptacle can be filled with a hot or cold beverage and closed by said cover, and whereby a person can depress said actuating member inwardly with the thumb of the hand holding said handle in the manner of a mug to open said opening and thence drink, the elongated configuration of said opening conforming relatively closely to the person's mouth covering said rim at said first point and a portion of the top surface of said plate as the receptacle is tilted upwardly to drink, the loose fit of said member through said rim when depressed inwardly permitting air to enter said receptacle through said cover to replace the beverage passing out said opening, the slant of said top plate when said receptacle is level causing any beverage spilled on the top surface of said plate to gravitate to said opening.

3. An assembly according to claim 2, in which said rim includes an integrally formed housing covering the extending end of said actuating member; and a lever pivoted about an horizontal axis in said housing, the extending end of said member engaging said lever below its horizontal pivot axis so that inward swinging movement of said lever by a person's thumb effects depressing of the actuating member inwardly.

* * * * *